US008511999B1

(12) United States Patent
Kimmel et al.

(10) Patent No.: US 8,511,999 B1
(45) Date of Patent: Aug. 20, 2013

(54) MULTIPLE PIECE TURBINE ROTOR BLADE

(75) Inventors: Keith D Kimmel, Jupiter, FL (US); Jack W. Wilson, Palm Beach Gardens, FL (US); Russell B Jones, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 658 days.

(21) Appl. No.: 12/731,928

(22) Filed: Mar. 25, 2010

Related U.S. Application Data

(60) Provisional application No. 61/165,319, filed on Mar. 31, 2009.

(51) Int. Cl.
*F01D 5/14* (2006.01)

(52) U.S. Cl.
USPC ..... 416/193 A; 416/224; 416/226; 416/232; 416/248

(58) Field of Classification Search
USPC ..... 416/97 R, 96 A, 233, 248, 225, 226, 416/193 A, 224, 229 R, 229 A, 232
See application file for complete search history.

(56) References Cited

U.S. PATENT DOCUMENTS 2,848,192 A * 8/1958 Hayes ..... 416/90 R
8,186,953 B1 * 5/2012 Kimmel ..... 416/97 R

FOREIGN PATENT DOCUMENTS

GB 1605191 A * 3/1983

* cited by examiner

*Primary Examiner* — Igor Kershteyn
(74) *Attorney, Agent, or Firm* — John Ryznic

(57) ABSTRACT

A turbine rotor blade of the spar and shell construction, the spar including a tip end with a dovetail shaped groove extending from the top, and a tip cap includes a dovetail shaped slot that engages with the spar groove to retain the tip cap in place. A shell made from a high temperature resistant material is secured in place between the platform and the tip cap. The platform includes a core extending into a hollow space formed by the shell and discharges impingement cooling air against the backside wall of the shell. The spar and the platform include fir tree configurations so that an assembled blade can be inserted into a slot of a rotor disk.

11 Claims, 5 Drawing Sheets

MULTIPLE PIECE TURBINE ROTOR BLADE

CROSS-REFERENCE TO RELATED APPLICATIONS

This application claims the benefit to a Provisional Patent Application 61/165,319 filed on Mar. 31, 2009.

FEDERAL RESEARCH STATEMENT

None.

BACKGROUND OF THE INVENTION

1. Field of the Invention

The present invention relates generally to a gas turbine engine, and more specifically to a turbine rotor blade with a spar and shell construction.

2. Description of the Related Art Including Information Disclosed Under 37 CFR 1.97 and 1.98

In a gas turbine engine, such as an industrial gas turbine (IGT) engine, a hot gas stream is passed through a turbine to produce mechanical energy. It is well known that the efficiency of the turbine, and therefore of the engine, can be increased by passing a higher temperature gas stream through the turbine. This is known as the turbine inlet temperature. The highest turbine inlet temperature is limited to the material properties of the turbine, especially the first stage stator vanes and rotor blades, since these airfoils are exposed to the highest temperature gas stream.

Higher turbine inlet temperatures can be can be obtained with a combination of improved material properties that will allow higher temperature exposure and improved airfoil cooling. Prior art turbine rotor blades are made from nickel super alloys produced by an investment casting process. It has been proposed in the past to form the blades from high temperature resistant materials such as tungsten or molybdenum or columbium to allow for higher turbine inlet temperatures. However, these materials have melting temperature so high that they cannot be cast or machined using investment casting processes.

The applicant has proposed to form a turbine blade or stator vane from one of these exotic high temperature resistant materials in which the blade is formed with multiple pieces. One such embodiment is the spar and shell configuration in which a shell having an airfoil shape with a leading edge and a trailing edge, and a pressure side wall and a suction side wall, is formed from one of these exotic high temperature resistant materials using a wire EDM process for cutting the shell into its desired shape from a block of these materials. The shell is then secured to the spar and tip cap by clamping the shell between the tip cap and the platform of the blade. In order to use this spar and shell configuration, a separate tip cap from the spar is required. However, because the blade is a turbine rotor blade, the tip cap is exposed to high stress levels to secure the shell against radial displacement due to the centrifugal force developed from blade rotation.

BRIEF SUMMARY OF THE INVENTION

A turbine rotor blade with a spar and shell construction, in which the spar includes a dovetail slot on the tip end that is engaged by a dovetail shaped projection extending from an underside of a tip cap to secure the tip cap to the spar and hold the shell in place against radial displacement between the tip cap and a platform of the blade. The spar includes a lower end with a fir tree configuration that is of the same size and shape as two legs extending from the platform section so that both pieces, when secure in place, with form a fir tree configuration that fits within a slot of a rotor disk.

DETAILED DESCRIPTION OF THE INVENTION

The multiple piece turbine rotor blade 10 of the present invention is for use in either an industrial gas turbine engine or an aero engine. The multiple piece construction allows for the shell, which has the airfoil shape for the blade with a leading edge and trailing edge and pressure side and suction sidewalls extending between the two edges, to be formed from a separate material than the spar and to be thermally uncoupled from the platform of the blade. The shell can be formed from an exotic high temperature resistant material such as Tungsten (for a stator vane) and Molybdenum or Columbium (for a rotor blade) which have very high melting temperatures but cannot be made into a thin walled airfoil by conventional investment casting or machining processes. These materials can be formed as a thin walled shell by a process like EDM (electric discharge machining) such as wire EDM that cuts the thin walled shell from a block of these exotic high temperature materials. A turbine rotor blade with a Molybdenum shell can be used under higher temperatures than the prior art investment cast nickel super alloy blades and therefore the engine will operate at higher efficiencies.

Figure 1:
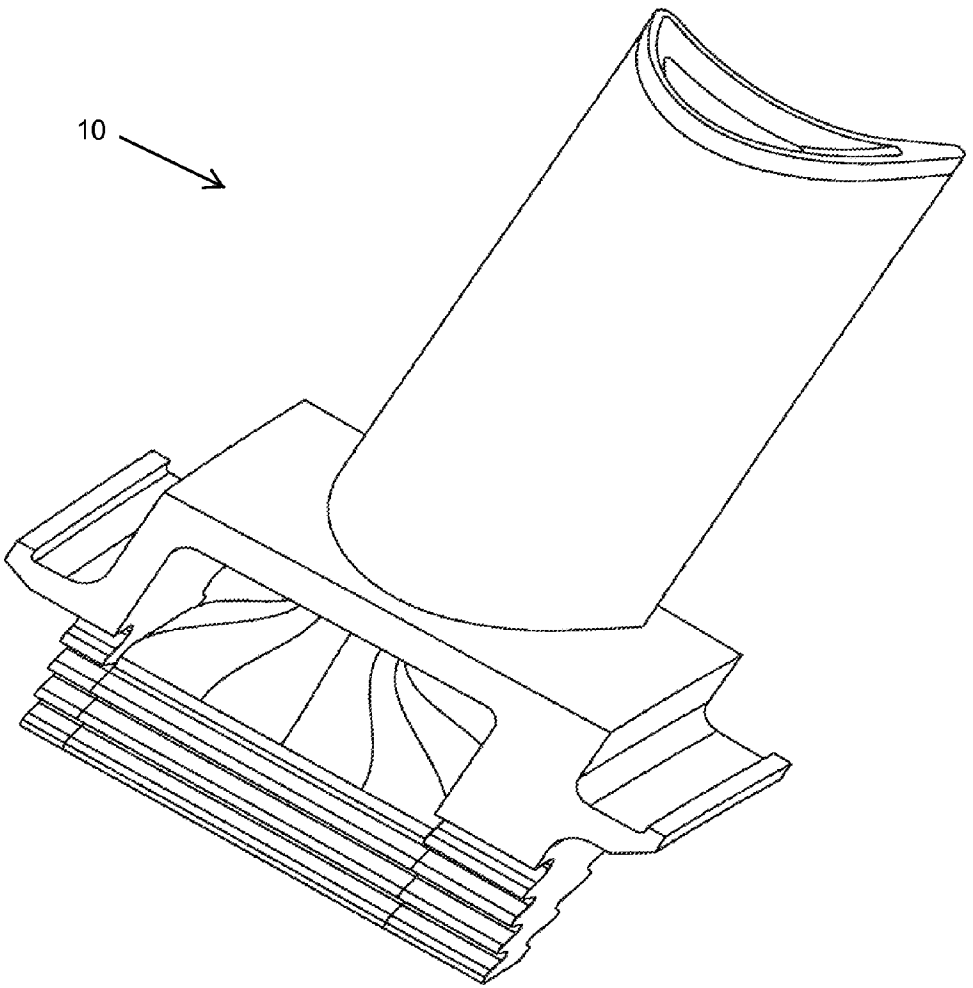
FIG. 1 shows an assembled multiple piece turbine rotor blade of the present invention.
Figure 2:
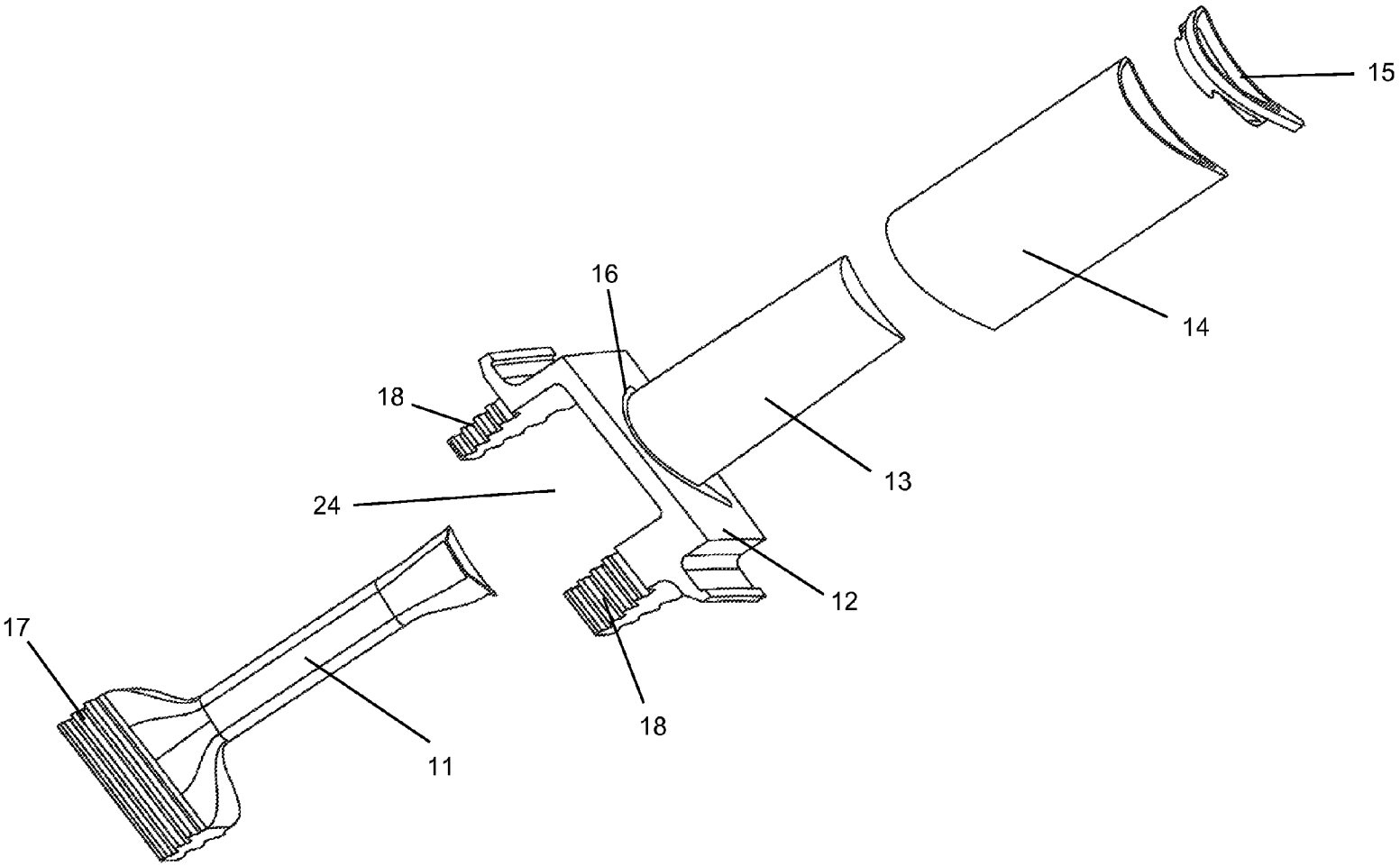
FIG. 2 shows an unassembled exploded view of the sp multiple piece turbine rotor blade of the present invention.
Figure 3:
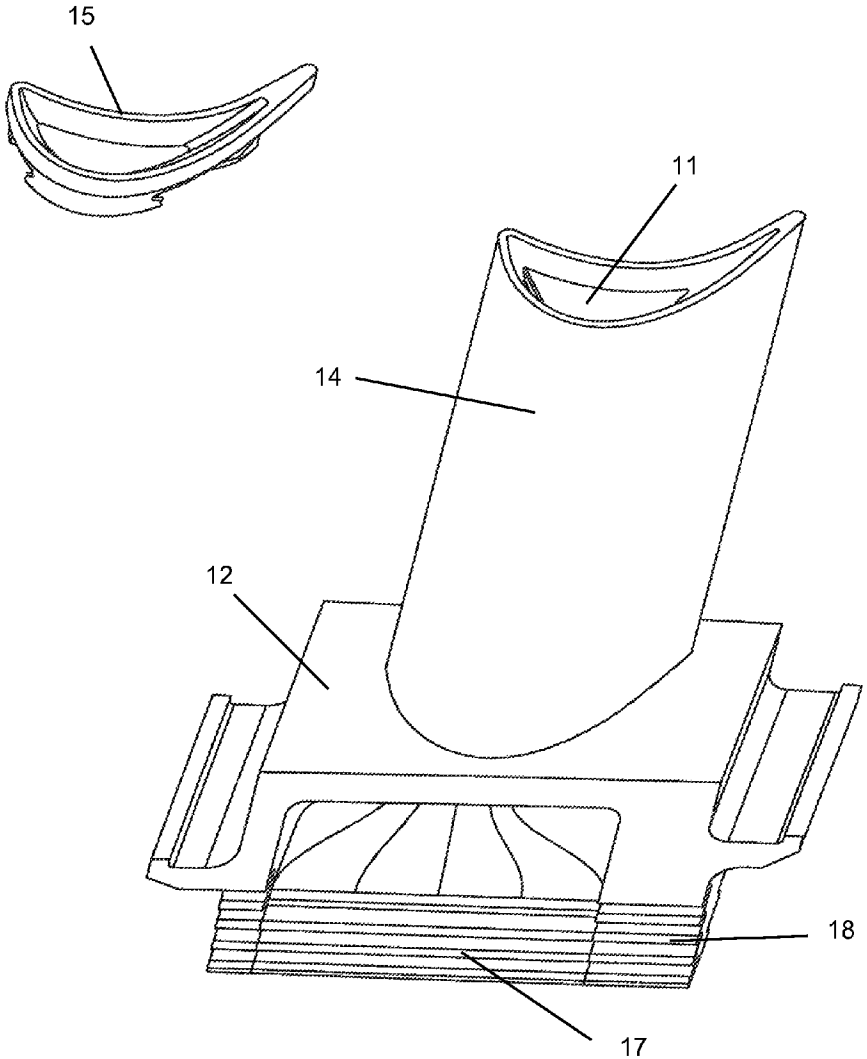
FIG. 3 shows a partially assembled multiple piece turbine rotor blade of the present invention.

FIG. 1 shows the multiple piece turbine rotor blade 10 in the final assembled state. The blade 10 includes a fir tree configuration for insertion into the standard slots in a turbine rotor disk. Thus, the multiple piece blade of the present invention can easily replace the prior art blades in the turbine. FIG. 2 shows the multiple piece turbine rotor blade in an exploded view where the blade is made from four or five parts: a spar 11, a platform 12, and core 13, a shell 14 and a tip cap 15. In one embodiment, the platform 12 and the core 13 are made as a single piece. In another embodiment, the core 13 is made as a separate piece from the platform 12. The shell 14 is formed from the high temperature exotic material such as Molybdenum or Columbium for a blade or tungsten for a vane. Tungsten has a higher melting temperature than Molybdenum and Columbium but is much more dense that the later two materials. Thus, the centrifugal force developed in a rotor blade with a tungsten shell would be too much for the spar 11 to secure the shell 14 in the blade assembly without excessive stress levels in the tip cap 15 to spar connection structure. A stator vane does not have any rotation and thus the centrifugal loads are not formed in a shell for a stator vane.

The spar 11 can be made from MP159 which has a very high strength. The core 13 can be made from IN100. The tip cap 15 can be made from a single crystal material, or can be made from Molybdenum. In the case of Molybdenum, the tip surface has a CBN, or Cubic Boron Nitride, coating applied to the surface to prevent damage to the Molybdenum spar tip end due to rubbing. To provide lower stress loads due to centrifugal forces acting from rotation of the blade, the spar 11 and the tip cap 15 can be made from Nickel Aluminide which has a very high strength but lower density than the nickel super alloys currently used that can be cast or machined.

The turbine rotor blade 10 is assembled by inserting the spar 11 through an opening formed within the platform 12 and then through the hollow core 13, and then inserting the shell 14 over the spar 11 and core 13 assembly. Both the spar 11 and the platform 12 include fir tree shaped roots 17 and 18 that are of the same size and shape so that together they form the fir tree configuration for insertion into the slot of the rotor disk. The platform includes two legs 18 on the sides that each has the fir tree shape. The core 13 extends from the platform 12 and is formed as a single piece with the platform 12 and its two legs 18. The core 13 includes an arrangement of impingement holes that discharge cooling air against a backside surface of the shell 13 to provide impingement cooling of the shell 13. In another embodiment, the core 13 forms a small spacing between the shell 14 so that cooling air flow will have a high velocity. The spar 11 also has a lower end or root end 17 that has an identical shaped fir tree configuration and the legs 18. The platform 12 includes a central opening or cavity in which the root 17 of the spar 11 will fit. The opening is large enough to allow for the spar 11 to be inserted up into the opening so that the fir tree grooves in the spar 11 are offset in a radial direction toward the tip cap 15 from the fir tree grooves in the two legs 18 of the platform 12 for the purpose of assembling the tip cap to the top end of the spar 11 as described further below. The platform 12 includes an airfoil shaped groove 16 extending around the platform openings in which a bottom end of the shell 14 fits to form a seal between the shell 14 and the platform 12.

Since the spar 11 is not exposed to the same temperatures as the shell 14, the spar 11 can be formed from the prior art investment casting process and from a material different than the shell 14 such as the nickel super alloys of the prior art investment cast turbine rotor blades. Also, the spar 11 can also be machined of features of a cast spar that can be finished by machining them into the spar.

Figure 4:
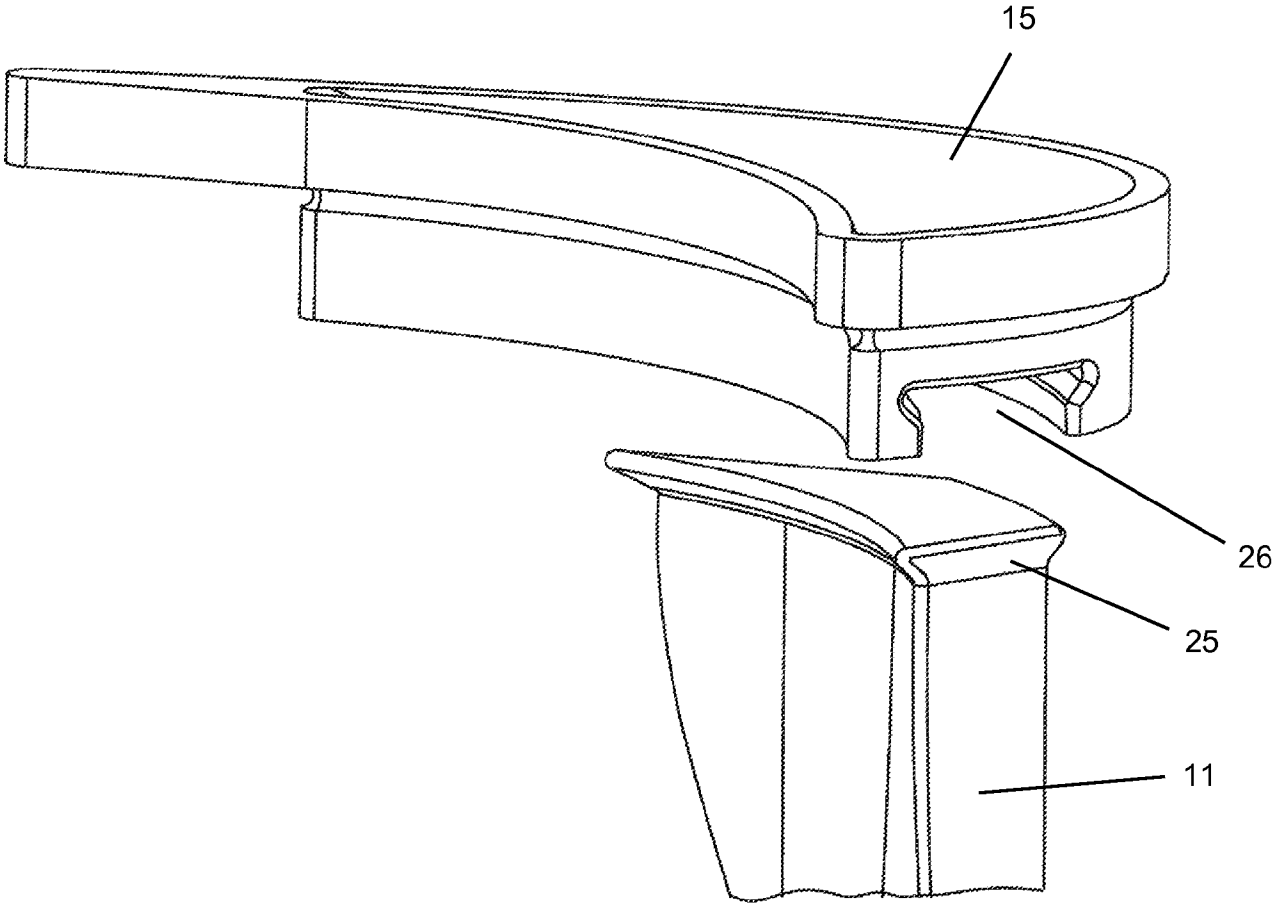
FIG. 4 shows a cross section side view of the assembled multiple piece turbine rotor blade of the present invention.
Figure 5:
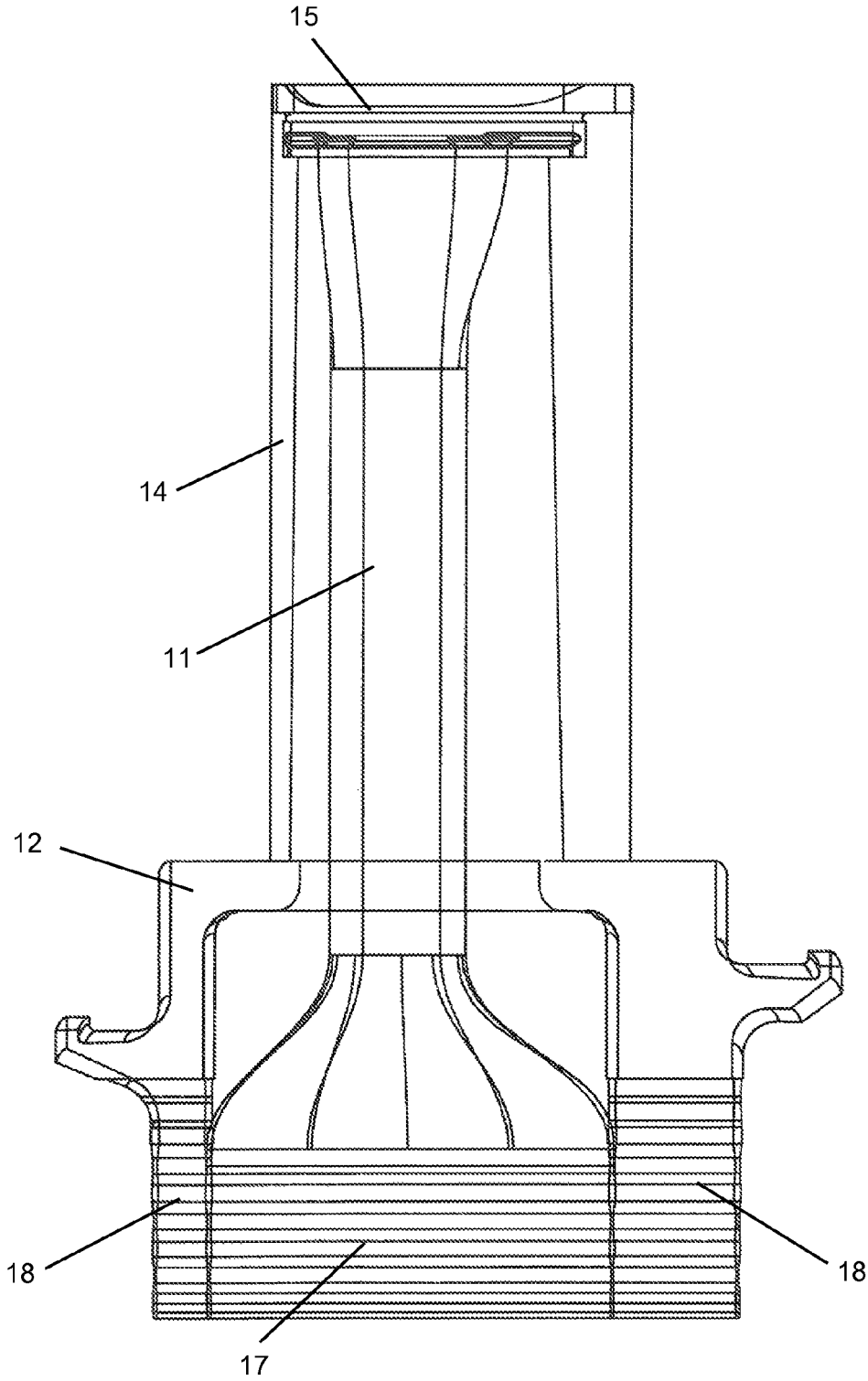
FIG. 5 shows a cross section detailed view of the replaceable tip cap and spar engagement features.

The spar 11 includes a tip end that has curved dovetail shaped projection 25 (FIG. 4) extending along the midpoint of the spar tip end in the chordwise direction from the leading edge to the trailing edge and opening on the top surface of the spar. The tip cap 15 includes an inward facing groove or slot 26 with a dovetail shaped cross section that will slide into the dovetail projection 25 of the spar 11. The tip cap 15 will thus be secured to the spar 11 against radial displacement by sliding into the spar tip projection 25.

The assembled the multiple pieces that form the blade assembly 10, the spar 11 is inserted into the hollow platform 12 and core 13 and extended beyond its normal position with respect to the core 13 so that the spar tip projection 25 will extend beyond the shell 14 top end to allow for the tip cap 15 to be inserted into the dovetail groove 25. When the shell 14 is placed into the platform groove 16 and onto the platform 12 and the spar 11 is inserted into the platform 12 and core 13, and when the tip cap 15 is secured within the dovetail groove 25 of the spar 11 tip end, the spar 11 is refracted from the platform 12 and core 13 so that the fir tree grooves in the spar root 17 and the platform legs 18 will align such that both parts 17 and 18 can be inserted into a slot of the rotor disk. As this relative position between the spar 11 and the platform 12 and core 13, the tip cap 15 will be properly positioned against the top end of the shell 14 to tightly secure the shell 14 to the spar 11. With the blade assembled, the shell 14 is thermally uncoupled from the platform 12 so that the thermal fight between these two blade parts is eliminated. Also, the shell 14 is only under compression due to the centrifugal force forcing the shell 14 up against the underside of the tip cap 15 during rotation of the blade. The shell 14 load is transferred to the tip cap 15 and then into the spar 11 and to the rotor disk through the fir tree configurations 17 and 18 of the root end of the spar. The shell 14 can have a near infinite life due to the lack of high stresses acting on the shell from rotation or exposure to the high temperatures. In another embodiment of the spar and shell turbine blade, the platform 12 and core 13 can be formed from two pieces.

To provide cooling for the blade, cooling air is supplied through the spar 11 and into the platform 12. From the platform 12 and core 13, the cooling air passes through an arrangement of impingement cooling holes against a backside wall of the shell 13 to provide impingement cooling. The spent cooling air is then channeled to a row of trailing edge exit holes or slots and discharged from the blade. Rows of film cooling holes in the leading edge region and along the pressure side and suction side walls can be included in the shell to provide film cooling if required. In another embodiment, cooling air is supplied through passages formed within the legs of the platform and then into the space formed between the shell 14 and the core 13. The cooling air velocity is high because the spacing between the core 13 and the shell 14 is small. The cooling air can flow out through film holes formed in the shell, or through a row of trailing edge exit holes formed within the shell, or out through tip cooling holes formed within the tip cap 15.

We claim the following:

1. A turbine rotor blade comprising:

a platform section having two legs each with a fir tree configuration;

a spar having a bottom end with a fir tree configuration and a top end with a dovetail shaped projection;

a tip cap having a dovetail shaped groove on a bottom side that engages with the dovetail shaped projection of the spar to secure the tip cap to the spar against radial displacement; and, a shell secured in place between the platform and the tip cap.

2. The turbine rotor blade of claim 1, and further comprising:

a core extending from the platform and into a hollow space formed by the shell; and, the core having an arrangement of impingement cooling holes to provide impingement cooling for a backside surface of the shell.

3. The turbine rotor blade of claim 2, and further comprising:

the core and the platform are formed as a single piece.

4. The turbine rotor blade of claim 1, and further comprising:

the shell is a single piece having an airfoil cross sectional shape and being formed of an exotic high temperature resistant material that cannot be easily cast or machined.

5. The turbine rotor blade of claim 4, and further comprising:

the shell is formed from molybdenum or columbium.

6. The turbine rotor blade of claim 1, and further comprising:

the dovetail groove and the slot have a curvature toward the pressure side wall of the airfoil.

7. The turbine rotor blade of claim 1, and further comprising:

the platform has an opening to receive the spar from the bottom side of the platform.

8. The turbine rotor blade of claim 6, and further comprising:

the dovetail shaped projection on the spar extends from a leading edge to a trailing edge of the airfoil.

9. The turbine rotor blade of claim 1, and further comprising:

the fir tree configuration of the platform legs and the spar are of the same size and shape so that an assembled blade will slide within a slot of a rotor disk.

10. The turbine rotor blade of claim 7, and further comprising:

the spar and the platform opening are of such size and shape to allow for the spar to be extended beyond the platform outer surface so that the tip cap can be inserted into the dovetail shaped projection with the shell in place on the platform.

11. The turbine rotor blade of claim 1, and further comprising:

the shell includes a row of exit holes along the trailing edge region to discharge cooling air from within the shell.

* * * * *